US005623117A

United States Patent [19]

Lewis

[11] Patent Number: 5,623,117

[45] Date of Patent: Apr. 22, 1997

[54] DELAY ORDNANCE SYSTEM

[75] Inventor: Donald J. Lewis, Scottsdale, Ariz.

[73] Assignee: Universal Propulsion Company, Inc., Phoenix, Ariz.

[21] Appl. No.: 567,939

[22] Filed: Dec. 6, 1995

Related U.S. Application Data

[62] Division of Ser. No. 141,260, Oct. 22, 1993, Pat. No. 5,499,579.

[51] Int. Cl.[6] ..... F42C 19/06; F42C 15/40

[52] U.S. Cl. ..... 102/331; 102/215; 102/216; 102/264

[58] Field of Search ..... 102/331, 215, 102/216, 262, 264

[56] References Cited

U.S. PATENT DOCUMENTS

| | | | |
|---|---|---|---|
| 3,967,557 | 7/1976 | Irish, Jr. | 102/70.2 R |
| 4,145,971 | 3/1979 | Graham et al. | 102/232 |
| 4,445,435 | 5/1984 | Oswald | 102/215 |
| 5,168,122 | 12/1992 | Furst et al. | 102/262 X |
| 5,335,598 | 8/1994 | Lewis et al. | 102/218 |

*Primary Examiner*—Peter A. Nelson
*Attorney, Agent, or Firm*—Ellsworth R. Roston; Charles H. Schwartz

[57] ABSTRACT

A pancake-configured housing holds first and second printed circuit boards. The first board includes electronic circuitry providing an adjustable timing delay and a first switch manually operated from a position external to the housing. The second board includes a pyrotechnic device and electronic circuitry for firing the device after the adjustable time delay. The second board also includes second switches with arms actuatable to convert such switches from first to second operative states. In the first state, the second switches short circuit the device and an energy storage member (e.g. a capacitor) on the second board and provide an open circuit to the circuitry on the first board. In the second state, the second switches provide a charging of the capacitor, the initiation of the timing through the circuitry in the first board with the first switch closed and the device firing by the capacitor energy after the adjustable delay. The housing has first and second integral fittings preferably oppositely disposed. The first fitting may receive an input mechanism as through a male coupling and the second fitting may receive an output mechanism as through a female coupling. Upon actuation, the input mechanism communicates with the movable arms of the second switches to operate the second switches to the second states. When the pyrotechnic device fires after the adjustable delay, the device actuates the output mechanism through the second fitting. The housing may respectively receive individual ones of different input and output mechanisms through the first and second fittings.

10 Claims, 2 Drawing Sheets

DELAY ORDNANCE SYSTEM

Figure 1:
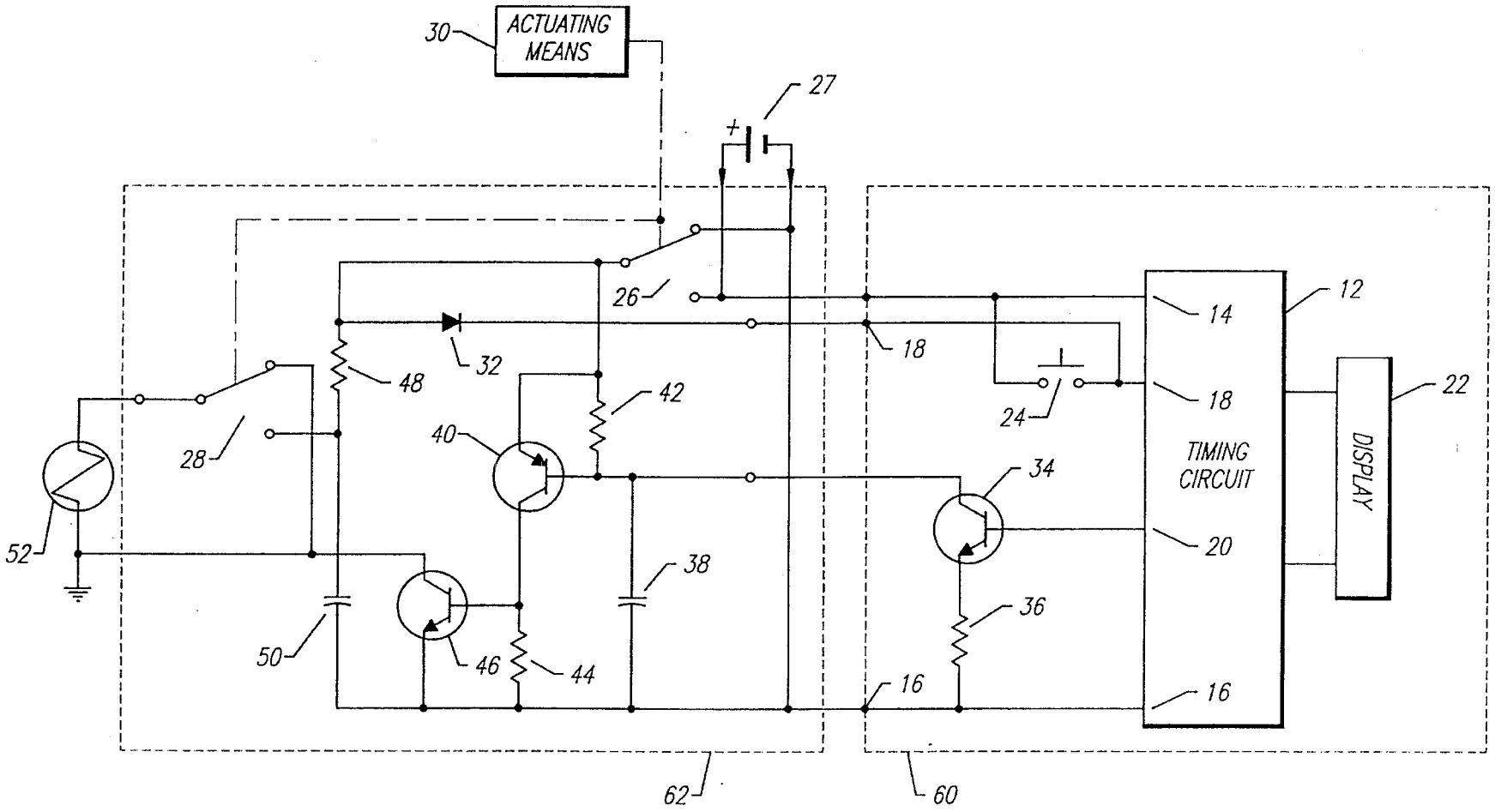

This is a division of application Ser. No. 08/141,260 filed Oct. 22, 1993 and now U.S. Pat. No. 5,499,579.

This invention relates to a delay ordnance system. More particularly, the invention relates to a delay ordnance system which includes any one of a plurality of input mechanisms, any one of a plurality of output mechanisms and an electronic timing and firing system adapted to be coupled on a universal basis to individual ones of the input and output mechanisms.

Ordinary systems generally have three (3) separate units: (1) an input mechanism for initiating a timing operation representing a pre-selected delay, (2) a timing and firing system for providing the pre-selected delay and (3) an output mechanism operated by the timing and firing system after the pre-selected delay. The input mechanism may have any one (1) of several different forms, all known in the prior art. For example, the input unit may provide (a) a gas input or a detonation unit, (b) a mechanized input such as a lanyard, (c) an electrical input such as an electrical current, (d) an input based upon the attainment of a particular temperature or (e) an input based upon a particular pressure.

The timing and firing systems in the prior art have generally been pyrotechnic. For example, a material has been combusted for a variable period of time dependent upon the characteristics of the combustible material. Such timing and firing systems have had certain inherent disadvantages. For example, the timing has not been very accurate. Furthermore, the time delay provided by combustible materials has not been very long. The timing and firing systems have also been disadvantageous because they have sometimes deteriorated with time and because they have sometimes provided an output at an inappropriate time to actuate the output unit. Furthermore, the delay times in such systems have not been able to be adjusted. These problems have occurred because the timing and firing systems have been chemical. Such problems have been known to exist in the timing and firing systems of the prior art for a relatively long period of time without any real ability to minimize the problems specified in this paragraph.

The output unit operated by the timing and firing unit may have a number of different forms. For example, the output unit may constitute a cutter for a reefing line or may provide heat from a thermal battery. Generally, the input and output mechanisms have been more advanced in the prior art than the timing and firing systems. Furthermore, there has been no standard relationship between the timing and firing system and individual ones of the input and output mechanisms. In other words, it has been difficult, if not impossible, in the prior art to provide a delay ordnance system in which an electronic timing and firing system can be coupled on a universal basis to any individual one of a plurality of input mechanisms and to any individual one of a plurality of output mechanisms.

This invention provides a delay ordnance system which overcomes the difficulties specified above. A timing and firing unit provides an accurate delay of a period which is adjustable through a wide range of values such as between a few seconds and twenty four (24) hours. The timing and firing unit is foolproof. In other words, the timing and firing unit can be actuated only by the input mechanism and the output mechanism can be actuated only after the adjustable delay from the time that the input mechanism has been actuated. The timing and firing unit does not deteriorate in its operation even when stored for long periods of time.

The timing and firing unit is disposed in a housing which is provided with a first standard fitting to receive any individual one of a number of input mechanisms and with a second standard fitting to receive any individual one of a number of output mechanisms. The housing for the timing and firing unit is compact and is constructed to insure the timing of the adjustable period after the actuation of the input mechanism and to insure the actuation of the output mechanism after the timing of the adjustable period.

In one embodiment of the invention, a pancake-configured housing holds first and second printed circuit boards. The first board includes electronic circuitry providing the adjustable timing delay and a first switch manually operated from a position external to the housing. The second board includes a pyrotechnic device and electronic circuitry for firing the device after the adjustable time delay. The second board chip also includes second switches with movable arms actuatable from first to second operative states.

In the first state, the second switches short circuit the device and an energy storage member (e.g. a capacitor) on the second board and provide an open circuit to the electronic circuitry on the first board and provide an open circuit to the circuitry on the first board. In the second state, the second switches provide a charging of the capacitor, the initiation of the timing through the electronic circuitry in the first board with the first switch closed and the device firing by the capacitor energy after the adjustable timing delay.

The housing has first and second integral fittings preferably oppositely disposed. The first fitting may receive an input mechanism as through a male coupling and the second fitting may receive an output mechanism as through a female coupling. Upon actuation, the input mechanism communicates with the movable arms of the second switches to operate the second switches from the first to the second states. When the pyrotechnic device fires after the pre-selected time delay, the device actuates the output mechanism through the second fitting. The housing may respectively receive individual ones of different input and output mechanisms through the first and second fittings.

Figure 3:
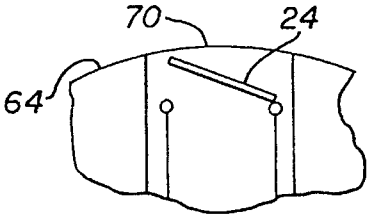
Figure 2:
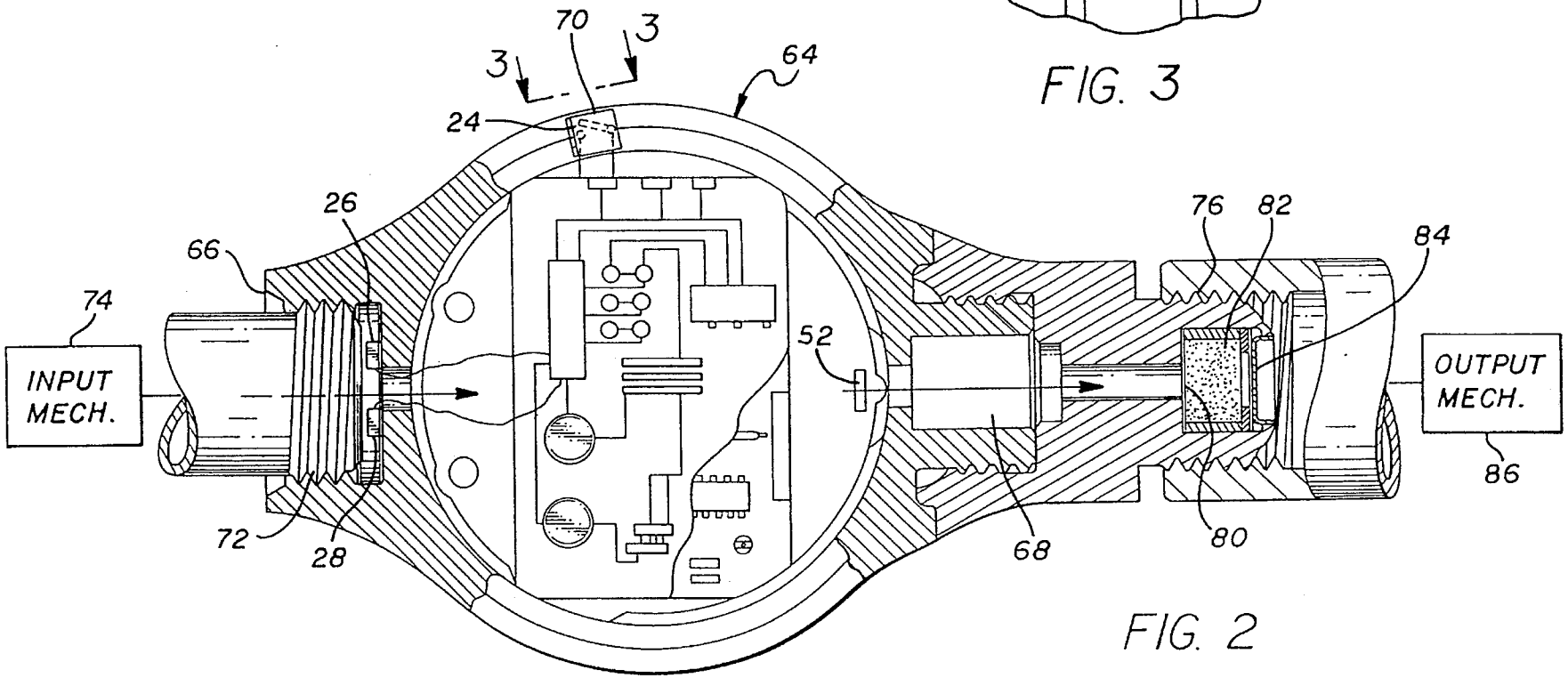

In the drawings:

FIG. 1 is a circuit diagram, partially in block form, of one embodiment of a timing and firing system for a delay ordnance system;

FIG. 2 is a sectional view, partially broken away, of a housing for the timing and firing system shown in FIG. 1 and of fittings extending from the housing for receiving on a universal basis an input mechanism adapted to energize the timing and firing system and an output mechanism adapted to be actuated by the timing and firing system; and FIG. 3 is a sectional view taken substantially on the line 3—3 of FIG. 2 and illustrates in additional detail the construction of a manually operated switch included in the timing and firing system shown in FIG. 1.

One embodiment of a timing and firing system for a delay ordnance system is generally indicated at 10 in the single Figure. The timing system 10 includes a timing circuit indicated in block form at 12. The timing circuit 12 may be formed in a conventional manner. Any different number of timing circuits may be used as the circuit 12. For example, the circuit 12 may constitute a watch circuit provided by the Timex Corporation.

The timing circuit 12 has several different terminals. These include a terminal 14 for receiving a position energizing voltage, a terminal 16 for providing a negative voltage, a terminal 18 for providing a start signal and a terminal 20 for providing an output signal. A display 22 provides a visual indication of the time delay pre-selected to be provided by the timing circuit 12. This time delay may be adjustable.

A manually operated switch 24 has one stationary terminal connected to the start terminal 18 of the timing circuit 12. A second stationary terminal of the switch 24 has a common connection with one stationary terminal of a single-pole double-throw switch 26 and the positive terminal of a battery 27. The movable arm of the switch 26 is ganged to the movable arm of a switch 28. The movable arms of the switches 26 and 28 are normally in the position shown in the single Figure. The movable arms of the switches 26 and 28 are operatively coupled to actuating means shown at 30 in block form in the single Figure. The actuating means may provide an input to the system 10 to initiate the operation of the system 10.

The actuating means 30 may have a number of different forms, all known in the prior art. For example, the actuating means 30 may constitute (a) a gas input or a detonation unit, (b) a mechanized input such as a lanyard, (c) an electrical input such as an electrical current, (d) an input based upon the attainment of a particular temperature or (e) an input based upon a particular pressure. All of these inputs may be converted by means well known in the art to mechanical motions of the movable arms of the switches 24 and 26.

The upper and lower stationary contacts of the switch 26 are respectively common with the positive and negative terminals of a power supply such as a battery 27. The negative terminal of the battery 27 is also connected to the negative terminal 16 in the timing circuit 12. The lower stationary contact of the switch 26 is connected to the positive terminal 14 in the timing circuit 12 and to one of the stationary contacts in the switch 24. The movable arm of the switch 26 is common with the anode of a diode 32 having its cathode connected to the start terminal 18 in the timing circuit 12.

The output signal on the terminal 20 in the timing circuit 12 is introduced to the base of an npn-type transistor 34. The source of the transistor 34 may be common with one terminal of a resistor 36 having a relatively low value such as approximately two hundred ohms (200 Ω). A connection is made from the second terminal of the resistor 36 to the negative terminal 16 in the timing circuit 12.

A connection is made from the collector of the transistor 34 to one terminal of a capacitor 38 having a suitable value such as approximately twenty seven thousandths of a microfarad (0.027 μf). The second terminal of the capacitor 38 is common with the negative terminal 16 in the timing circuit 12. The collector of the transistor 34 is also connected to the base of a transistor 40 which may be a PNP transistor. A resistor 42 having a suitable value such as approximately two hundred Kilohms (200 KΩ) is connected between the base and the emitter of the transistor 40. The source of the transistor 40 is common with the movable arm of the switch 26.

A resistor 44 is connected between the collector of the transistor 40 and the negative terminal 16 in the timing circuit 12. The resistor 44 may have a suitable value such as approximately two hundred Kilohms (200 KΩ). A connection is also made from the collector of the transistor 40 to the base of a transistor 46 which may be NPN type. The source of the transistor 46 is common with the negative terminal 16 in the timing circuit 12.

A resistor 48 and a capacitor 50 are in series between the movable arm of the switch 26 and the source of the transistor 46. The resistor 48 may have a suitable value such as approximately three hundred and eighty three ohms (383 Ω). The capacitor 50 may have a suitable value such as approximately sixty eight microfarads (68 μf). The terminal common to the resistor 48 and the capacitor 50 is connected to the lower stationary contact of the switch 28 in the single Figure.

The upper stationary contact of the switch 28 in the single Figure is common with the collector of the transistor 46. A connection is made from the movable arm of the switch 28 to an ungrounded terminal of a pyrotechnic device 52. The other contact of the pyrotechnic device 52 is connected to a ground such as a casing in the timing system 10. When fired, the pyrotechnic device 52 may actuate an output unit (not shown) in a manner well known in the art. For example, the output unit may constitute a cutter for a reefing unit or may provide actuation for a thermal battery.

When the movable arms of the switches 26 and 28 engage the upper stationary contacts of the switches as shown in the single Figure, the switch 26 provides a short circuit across the capacitor 50 and the resistor 44, and the switch 28 provides a short circuit across the pyrotechnic squib 52. This prevents the capacitor 50 from being charged and the pyrotechnic squib 52 from being fired. At the same time, the voltage on the battery 27 is applied to the positive terminal 14 in the timing circuit 12 to provide power to operate the timing circuit.

When the switch 24 is manually closed, the timing circuit 12 provides an operational checkout of the timing circuit 12. The movable arms of the ganged switches 26 and 28 become moved from the upper position to the lower position by an operation of the actuating means 30 which may constitute any one of a number of different inputs. When the movable arm of the switch 26 engages the lower stationary contact of the switch, a voltage is applied from the battery 27 through the diode 32 to the start terminal 18 in the timing circuit 12. This initiates the timing of the pre-selected period in the timing circuit 12.

Current also flows from the battery 27 through a circuit including the resistance 48 and the capacitor 50 to charge the capacitor 50. The capacitor 50 becomes charged in a relatively short period of time such as less than one tenth of a second (0.1 sec.). The charging of the capacitor 50 prepares the capacitor 50 to be able to fire the pyrotechnic device. It is desirable for the capacitor 50 to be charged in a relatively short time, particularly when the pre-selected timing period measured by the timing circuit 12 is relatively low.

The timing circuit 12 times the pre-selected period. At the end of the pre-selected period, the timing circuit 12 produces a series of pulses on the line 20. These pulses trigger the transistor 34 into a state of conductivity at the same frequency as the pulses. When the transistor 34 becomes conductive, a relatively low voltage is produced on the collector of the transistor 34. This low voltage discharges the capacitor 38. The low voltage is also introduced to the base of the transistor to make the transistor 40 conductive. The pulses are filtered by capacitor 38 as a result of the charging of the capacitor through a circuit including the battery 27, the switch 26 and the base/emitter junction of the transistor 40.

The flow of current through the transistor 40 causes a relatively high voltage to be produced across the resistor 44. This high voltage establishes a state of conductivity in the transistor 46. When the transistor 46 becomes conductive, it has a relatively low impedance. This causes a circuit to be established through the capacitor 50, the switch 28 (in the second state of operation), the pyrotechnic squib 52 and the transistor 46. The capacitor 50 then discharges through the pyrotechnic squib 52 to fire the pyrotechnic squib. The firing of the pyrotechnic squib 52 initiates the operation of an output unit (not shown).

It should be appreciated that the timing and firing system 10 may be disposed on printed circuit boards. One printed circuit board may be formed from the components included within a broken-line rectangle 60 in the single Figure. Such components may be considered to relate to delay circuitry. Another printed circuit board may be formed from the components included within a broken-line rectangle 62 in the single Figure. Such components may be considered to relate to firing circuitry. Each of the printed circuit boards 60 and 62 may be formed in a thin pancake-like configuration having substantially a cylindrical configuration conventional in some printed circuit boards. For example, the diameter of each of the printed circuit boards may be approximately three quarters of an inch (¾").

The two (2) printed circuit boards 60 and 62 may be disposed in a back-to-back relationship in a housing generally indicated at 64 in FIG. 2 to make the housing compact. The housing 64 may be provided with a generally cylindrical configuration illustratively having a diameter less than approximately one and one half inches (1½") and having an axial length less than approximately one half inch (½"). The housing 64 is provided with open ends 66 and 68 at opposite ends of the generally cylindrical configuration. The movable arms of the ganged switches 26 and 28 are disposed at the open end 66. The pyrotechnic fuse 52 is disposed at the open end 68. An opening 70 is provided in the housing 64 at a position displaced from the open ends 66 and 68. The movable arm of the switch 24 extends through the opening 70 for manual actuation.

A fitting 72 extends from the open end 66, preferably integrally with the housing 64. The fitting 72 may be internally threaded to receive an input mechanism indicated generally at 74. The input mechanism 74 may be externally threaded. The input mechanism 74 may have any one of several different forms. For example, the input mechanism 74 may provide (a) a gas input or a detonation input, (b) a mechanized input such as a lanyard, (c) an electrical input such as an electrical current, (d) an input based upon the attainment of a particular temperature or (e) an input based upon a particular pressure. However, no one of the inputs of the prior art is in a form capable of being coupled on a universal basis to the fitting 72. When the input mechanism 74 is actuated, it produces a force which actuates the movable arms of the switches 26 and 28 from the upper position shown in FIG. 1 to the lower position shown in FIG. 1.

A fitting 76 extends from the open end 68 of the housing 64, preferably externally relative to the housing 64. Preferably, the fitting 76 is disposed at the opposite diametrical end from the fitting 72. The fitting 76 may be externally threaded to distinguish it from the fitting 72. A disc 80 may be disposed in the fitting 76. Combustible material 82 is disposed against the disc 80 and adjacent a disc 84 displaced from the disc 80. Any suitable combustible material well known in the prior art may be used as the material 82.

When the pyrotechnic device 52 is fired, it produces a gas which expands with a sufficient force to rupture the disc 80. The heat from the gas produced by the device 52 then combusts the material 82. The resultant gases produce a rupture in the disc 84. The gases from the material 82 then actuate an output mechanism 86 which is coupled to the fitting 76. For example, the output mechanism 86 may be internally threaded to mate with the fitting 76.

It will be appreciated that the coupling between the fitting 72 and the input mechanism 74 and between the fitting 76 and the output mechanism 86 are only illustrative. For example, the fitting 72 may be internally threaded and the input mechanism 74 may be externally threaded. Similarly, the fitting 76 may be internally threaded and the output mechanism 86 may be externally threaded. It will also be appreciated that other types of couplings than threadings between the housing 64 and the input mechanism 74 between the fitting 76 and the output mechanism 86 also be used without departing from the scope of the invention.

In effect, the discs 80 and 84 and the combustible material 82 may be considered to constitute a gaseous amplifier for amplifying the gaseous expansion provided by the pyrotechnic device 52, thereby insuring the actuation of the output mechanism 86. It will be appreciated, however, that it may be possible to actuate the output mechanism 86 directly from the expanding gases provided by the pyrotechnic device 52.

The output mechanism 86 may have a number of different forms. For example, the output mechanism 86 may constitute a cutter for a reefing line or may provide heat from a thermal battery. However, none of the output mechanisms of the prior art is in a form to be coupled on a universal basis to the fitting 76.

The apparatus constituting this invention has certain important advantages. It provides a timing and firing unit 10 which operates reliably to provide a delay variable through a wide range of values when the input mechanism 74 is actuated. The timing and firing unit 10 can be stored for long periods of time without any deterioration in its capabilities. The timing and firing unit 10 provides a delay which can be pre-selected with great precision through a wide range of values.

The apparatus constituting this invention also has other important advantages. It disposes the timing and firing unit 10 on a pair of printed circuit boards 60 and 62 which are contained within a housing 64. The housing 64 is compact and is in a configuration which provides for easy handling. The housing 64 provides fittings 66 and 72 which are respectively constructed to receive the input mechanism 74 and the output mechanism 86. In this way, the apparatus of this invention provides a delay ordnance system in which any individual one of a plurality of input mechanisms can actuate any individual one of a plurality of output mechanisms after a pre-selected delay.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for use with an input mechanism and an output mechanism to provide for an operation of the output mechanism a pre-selected time after the operation of the input mechanism, a housing having first and second openings, integrated circuit means disposed in the housing, the integrated circuit means having a manually movable arm extending through the first opening in the housing, the manually movable arm being included in a switch having a stationary contact disposed in the housing to become engaged by the manually movable arm upon a manual movement of the arm for defining a closed switch, switching means having a movable arm and a pair of stationary contacts respectively to provide first and second operative relationships, the movable arm for the switching means being disposed at the second opening in the housing, the integrated circuit means including timing and firing circuitry having a pyrotechnic device and the switching means and the first switch, the timing and firing circuitry being operative in the first operative relationship of the switching means to prevent the pyrotechnic device from firing and being operative in the second operative relationship of the switching means and in the closure of the closed switch to fire the pyrotechnic device after the pre-selected time, the housing having a first fitting disposed in communication with the second opening for receiving the input mechanism and for moving the movable arm of the switching means from the first operative relationship to the second operative relationship when the input mechanism is actuated, the housing having a second fitting disposed in communication with the pyrotechnic device for receiving the output mechanism to obtain an operation of the output mechanism when the pyrotechnic device is fired.

2. In a combination as set forth in claim 1, the integrated circuit means including a first integrated circuit chip for providing the timing circuitry and including a second integrated circuit chip for providing the firing circuitry and the pyrotechnic device and the switching means being disposed on the second integrated circuit chip and the switch being disposed on the second integrated circuit chip.

3. In a combination as set forth in claim 1, energy storage means, the switching means including first and second ganged switches each having first and second operative relationships, the first ganged switch being connected to the pyrotechnic device to short the pyrotechnic device in the first operative relationship, the second ganged switch being connected to the energy storage means to short the energy storage means in the second operative relationship, the energy storage means being included in the firing circuitry to discharge through the pyrotechnic device and the first ganged switch in the second operative relationship of the second ganged switch after the pre-selected time from the actuation of the input mechanism, the timing circuit being connected to the second ganged switch in the second operative relationship of the second ganged switch to initiate the measurement of the pre-selected time after the actuation of the input mechanism.

4. In a combination as set forth in claim 1, the first fitting having an individual one of external and external threads to receive the input mechanism, the second fitting having the other one of external and internal threads to receive the output mechanism.

5. In combination for use with an input mechanism and an output mechanism to provide for an operation of the output mechanism a pre-selected time after the operation of the input mechanism, printed circuit means, a housing constructed to hold the integrated circuit means, a pyrotechnic device included in the printed circuit means, switching means having first and second operative relationships, the switching means being included in the printed circuit means, a first fitting extending integrally from the housing for receiving the input mechanism and for communicating with the switching means for providing for a change in the first switching means from the first operative relationship to the second operative relationship when the input mechanism is actuated, the printed circuit means being constructed to prevent the pyrotechnic device from firing with the switching means in the first operative relationship and to provide a pre-selected delay upon the operation of the switching means in the second operative relationship and to fire the pyrotechnic device after the pre-selected delay, and a second fitting extending integrally from the housing for receiving the output mechanism and for communicating with the pyrotechnic device to provide for an actuation of the output mechanism after the pyrotechnic device has fired.

6. In a combination as set forth in claim 5, a switch extending from the housing for manual operation and connected in the printed circuit means for preventing the pre-selected delay from being initiated until the manual operation of the switch.

7. In combination for use with an input mechanism and an output mechanism to provide for an operation of the output mechanism a pre-selected time after the operation of the input mechanism, printed circuit means, a housing constructed to hold the integrated circuit means, a pyrotechnic device included in the printed circuit means, switching means having first and second operative relationships, the switching means being included in the printed circuit means, a first fitting extending integrally from the housing for receiving the input mechanism and for communicating with the switching means for providing for a change in the first switching means from the first operative relationship to the second operative relationship when the input mechanism is actuated, the printed circuit means being constructed to prevent the pyrotechnic device from firing with the switching means in the first operative relationship and to provide a pre-selected delay upon the operation of the switching means in the second operative relationship and to fire the pyrotechnic device after the pre-selected delay, and a second fitting extending integrally from the housing for receiving the output mechanism and for communicating with the pyrotechnic device to provide for an actuation of the output mechanism after the pyrotechnic device has fired, the printed circuit means including a first printed circuit board and a second printed circuit board, the housing being constructed to hold the first and second printed circuit boards in a stacked relationship, the first printed circuit board providing electronic circuitry means for timing the pre-selected time delay after the manual operation of the switch and the operation of the switching means from the first operative relationship to the second operative relationship, the second printed circuit board providing electronic circuitry means for preventing the pyrotechnic device from firing in the first operative relationship of the switching means and providing for the firing of the pyrotechnic device in the second operative relationship of the switching means after the pre-selected time delay.

8. In a combination as set forth in claim 5, the first and second fittings being oppositely disposed on the housing and having individual characteristics to provide for the reception only of the input mechanism by the first fitting and the reception only of the output mechanism by the second fitting.

9. In a combination as set forth in claim 5, the housing having an opening communicating with the first fitting and the switching means being disposed in the opening to become operative by the input mechanism from the first operative relationship to the second state operative relationship.

10. In a combination as set forth in claim 5, the housing having an opening communicating with the second fitting and the pyrotechnic device being disposed in the opening to generate gases when fired for actuating the output mechanism when the pyrotechnic device is fired.

* * * * *